United States Patent [19]

Howard, Sr.

[11] Patent Number: 4,790,075

[45] Date of Patent: Dec. 13, 1988

[54] PORTABLE REMOVABLE GUN SIGHT

[76] Inventor: Alfred R. Howard, Sr., 110 E. Summit Rd., Wilmington, Del. 19804

[21] Appl. No.: 85,532

[22] Filed: Aug. 14, 1987

[51] Int. Cl.[4] ..... F41G 1/10

[52] U.S. Cl. ..... 33/233

[58] Field of Search ..... 33/233, 235, 238, 250, 33/251, 261; D22/110, 109

[56] References Cited

U.S. PATENT DOCUMENTS

| | | | |
|---|---|---|---|
| D. 34,244 | 3/1901 | Barfer | D22/109 |
| D. 253,545 | 11/1979 | Chesnut | 33/233 X |
| 807,710 | 12/1905 | Bassell et al. | 33/233 |
| 2,498,329 | 2/1950 | Barnes | 33/233 |
| 2,795,048 | 6/1957 | Seymour et al. | 33/233 |
| 2,970,380 | 2/1961 | Hill | 33/261 |
| 3,840,995 | 10/1974 | Freiling | 33/233 |

FOREIGN PATENT DOCUMENTS

| | | | |
|---|---|---|---|
| 14275 | 12/1904 | Norway | 33/261 |
| 27123 | of 1905 | United Kingdom | 33/233 |
| 159075 | 2/1921 | United Kingdom | 33/261 |
| 589157 | 6/1947 | United Kingdom | 33/233 |

*Primary Examiner*—Harry N. Haroian

*Attorney, Agent, or Firm*—Lipton & Famiglio

[57] ABSTRACT

The present invention is an improved removable gun sight for shotguns, rifles and other firearms comprising a single, light weight part for screwless, snap on attachment to the tubular part of a gun. The device is pocket size and portable and is easy to install and adjust on a firearm.

1 Claim, 1 Drawing Sheet

PORTABLE REMOVABLE GUN SIGHT

BACKGROUND OF THE INVENTION

1. Field of the Invention

This invention relates to an improved gun sight that can be size adapted to be used on shotguns, rifles and other firearms. Hunters find it useful, when they are in the field, to have a gun sight that does not have to be installed on a gun with screws, is not complicated to use and can be easily carried without a risk of breakage. The present invention is light weight and has a self springing mechanism for easy installation and adjustment on a gun.

Accordingly, it is the primary object of the present invention to provide an easily mounted and adjusted, removable gun sight which can be carried by the user in his or her pocket when the sight is not in use.

A further object of this invention is to provide a screwless and boltless removable gun sight.

A still further object of this invention is to provide a gun sight that can be adjusted to the user's preferred position along the barrel of the gun.

A further object of the present invention is to provide a sighting device which is attachable to the firearm by the snap-on action of a built in spring mechanism that is an integral part of the structure of the gun sight.

A still further object of the present invention is to provide a simple, low cost design that is easily constructed in the desired shape.

These and other objects will become apparent from a consideration of the description of a preferred embodiment and an alternate embodiment of the invention and from the drawings and appended claims.

2. Description of the Prior Art

In the field of gunsighting devices a number of configurations have been suggested. These appear in utility patents as well as ornamental design patents. U.S. Pat. No. 34,244 (1901) by L. Barger features a design for a gun sight composed of a band or strip bent in a clover-like contour with semicircular portions and with inwardly extending ends that have holes in them by which the sight can be screwed on a rifle. The Barger design differs from the present invention in that it is attached to the firearm by means of screws and also has an entirely different ornamental shape. U.S. Pat. No. Des. 253,545 teaches a plastic snap-on sighting attachment for a telescopic device. It lacks the pocket portability of the present invention and the versatility of the present invention as applied to and sized for a variety of firearms. U.S. Pat. No. 3,840,995, by Freiling, is a rear sight for single barrel shotguns with a pair of resilient clips for engaging the barrel of the gun. Unlike the present invention, the Freiling invention is adapted to fit the shotgun at the juncture between the receiver and the barrel only and is not adjustable along the barrel of the gun. U.S. Pat. No. 2,386,420 by Bailey et al teaches a detachable front gun sight for use with U.S. Rifle Cal. 0.30, M1 type of rifles. Its only similarities to the present invention are its removability and its curved slot for installation on the gun. It lacks the simplicity of construction and pocket portability of the present invention. U.S. Pat. Nos. 3,497,224, 2,498,329, Des. 151,408 and 2,058,305 show sights that are attached to rifles and that can be removed. U.S. Pat. No. 3,499,224, by Squier et al includes a front sight and a rear sight having two sighting elements forming a V shape that is not present in the instant invention. U.S. Pat. No. 2,498,329 by Barnes includes a resilient cylindrical clamping member that engages the barrel of a shotgun and is designed to be fixed securely in position on the gun's barrel by means of screws. U.S. Pat. No. Des. 151,408 by Richards is a circular shaped sight that is screwable onto the barrel of a shotgun. Richards lacks the spring action of the present device and requires fixation to the gun prior to use. U.S. Pat. No. 2,058,305 by Forsling, a front rifle sight, describes a tubular front sighting device having a transverse slot extending halfway across the tube with a sight member positioned in the slot. A hood, surrounding and slidable on the tube keeps the sight member in position. It lacks the simplicity, low cost and ease of construction of the present invention.

SUMMARY OF THE INVENTION

The present invention consists of a gun sight for detachable connection to the barrel of a shotgun, rifle or other similar firearm. The gun sight comprises a nearly circular split band with curved, gun gripping, hand-like projections extending from the split ends of the nearly circular split band. A sighting means is located within the circular split bad. In one embodiment, the sighting means is a second circular structure with a pointing nub located on its inside circumference. The sighting means is attached to the inside circumference of the nearly circular split band by an "arm" projecting therefrom.

In a second embodiment of the present sighting device, the sighting structure within the first nearly circular split band, has straps that extend from slots in the circumference of the nearly circular band, crisscrossing in the center of the circular shape to provide a sighting means.

Both embodiments of the present device are improvements over the prior art in that they are pocket sized, easily installable without the need for screws or other securing devices, self adhering to the barrel of a gun and are flat and self containing.

DETAILED DESCRIPTION OF THE DRAWINGS

Figure 1A:
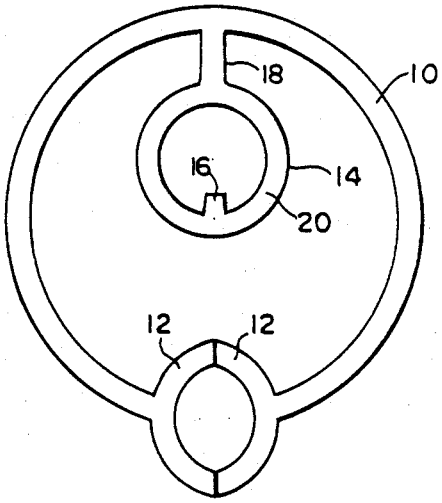
FIG. 1A is a front elevation of one form of the present invention in a closed position.
Figure 1B:
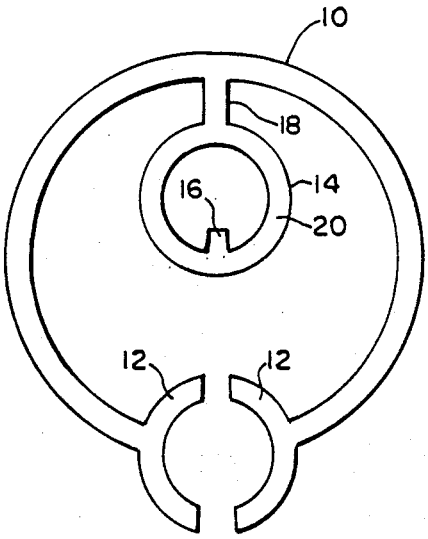
FIG. 1B is a front elevation of the gun sight in FIG. 1A with the ends open to receive a gun.

Referring to the drawings, wherein like numbers refer to like structures:

The sight described in FIG. 1A comprises a nearly circular structure 10 that has the elasticity to spring open and to close at its open ends. Gripping structures 12 grip the cylindrical barrel of a gun (not shown). In one embodiment, the device is made of a plastic material although it also could be manufactured of "spring" steel or other flexible material. Molded at or pasted to the ends of the said nearly circular structure 10 are the semicircular, hand-like projections 12. In the embodiment of the invention, shown in FIG. 1A, a sighting structure 14 extends downward on projecting arm 18 from the side of the nearly circular structure 10, directly across from gripping, hand-like projections 12. The sighting means 14 of the present embodiment is a circle 20 with a projecting nub 16 radiating from the bottom of the inside circumference of circle 20. When the user desires to employ the invention, the ends of the nearly circular structure 10 are pulled apart as shown in FIG. 1B and the hand-like projections 12 are fitted around the barrel of the gun at a position preferred by the user. The self clamping action of the projections 12 holds the sight device on the gun without the need for screws or other fastening means.

Figure 2:
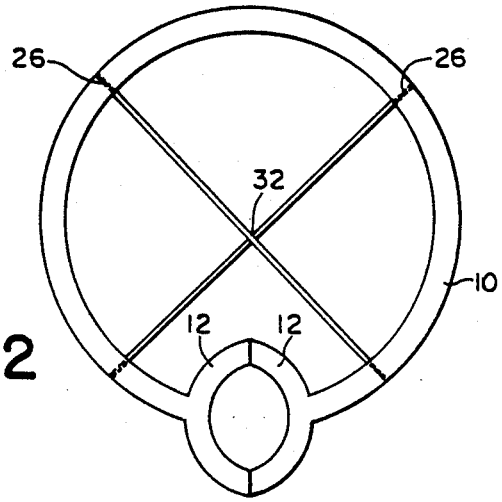
FIG. 2 is a front elevation of a different form of the present invention in a closed position.

FIG. 2 describes a second embodiment of the invention wherein a nearly circular structure 10, with the same gripping, hand-like projections 12 found in FIGS. 1A and 1B, has a sighting means composed of crisscrossed bands 22 countersunk at slots 26 in structure 10 which are secured to structure 10 by glue or other securing methods. The point 32, at which the crisscrossed bands cross, is used as the sighting structure in this second embodiment.

Figure 3:
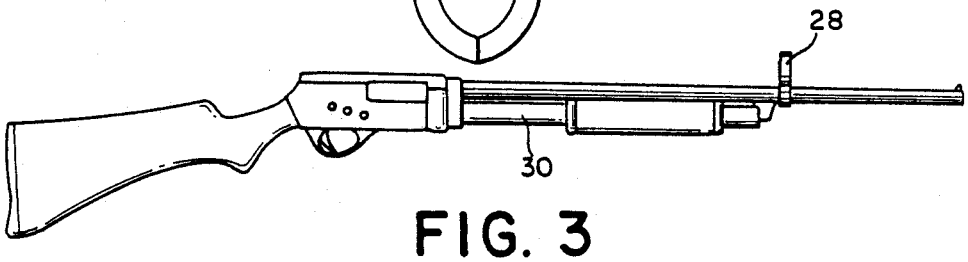
FIG. 3 is a side view of the barrel of a shotgun showing the present invention mounted in one position thereon.

FIG. 3 shows the placement of the invention at a chosen position 28 on a gun 30. The positioning of the sight on the barrel is at the user's preference and is not limited by the present drawing.

Although the present invention has been described with reference to the particular embodiments herein set forth, it is to be understood that the present disclosure has been made only by way of example and that numerous changes in details of construction may be resorted to without departing from the spirit and scope of the invention. Thus, the scope of the invention should not be limited by the forgoing specification, but rather only by the scope of the claims that are appended hereto.

What is claimed is:

1. An improved gun sight attachment for detachable connection to a shotgun, rifle or other firearm comprising:

(a) a nearly circular clamping member, made of springable material, with means located at its ends for screwless engagement about the barrel of a firearm; and (b) a sighting means connected within said circular member, consisting of an arm connected to the inside of the circumference of said nearly circular clamping member, extending down from its midpoint, having a second circle connected to the arm; and (c) a sighting structure mounted within said second circle.

* * * * *